US008684677B1

(12) United States Patent
Mann et al.

(10) Patent No.: US 8,684,677 B1
(45) Date of Patent: Apr. 1, 2014

(54) TURBOCHARGER

(71) Applicants: Stuart J. Mann, Huddersfield (GB); John Frederick Parker, Huddersfield (GB); Martin David Taylor, Huddersfield (GB); Robert Morphet, Huddersfield (GB)

(72) Inventors: Stuart J. Mann, Huddersfield (GB); John Frederick Parker, Huddersfield (GB); Martin David Taylor, Huddersfield (GB); Robert Morphet, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

(21) Appl. No.: 13/623,234

(22) Filed: Sep. 20, 2012

Related U.S. Application Data

(63) Continuation of application No. 12/497,274, filed on Jul. 2, 2009, now abandoned.

(51) Int. Cl.
*F01D 17/14* (2006.01)

(52) U.S. Cl.
USPC ..... 415/158

(58) Field of Classification Search
USPC ..... 415/157, 158, 159, 165, 208.1, 208.2, 415/208.3
See application file for complete search history.

(56) References Cited

U.S. PATENT DOCUMENTS

| | | | | |
|---|---|---|---|---|
| 5,868,552 | A * | 2/1999 | McKean et al. | 415/158 |
| 6,401,563 | B1 * | 6/2002 | Franklin | 74/469 |
| 6,659,718 | B2 * | 12/2003 | Jinnai et al. | 415/164 |
| 6,931,849 | B2 * | 8/2005 | Parker | 60/602 |

* cited by examiner

*Primary Examiner* — Richard Edgar
(74) *Attorney, Agent, or Firm* — Krieg DeVault LLP; Clifford W. Browning

(57) ABSTRACT

According to an embodiment of the present invention, there is provided a variable geometry turbine comprising: a turbine wheel mounted on a turbine shaft within a housing assembly for rotation about a turbine axis, the housing assembly defining a gas flow inlet passage upstream of the turbine wheel; an annular wall member defining a wall of the inlet passage and which is displaceable in a direction substantially parallel to the turbine axis to control gas flow through the inlet passage; at least one moveable rod operably connected via a first end of the rod to the annular wall member, the rod being moveable to control displacement of the annular wall member, the rod extending in a direction substantially parallel to the turbine axis; wherein the rod is provided with a region of reduced radius which extends only partly around the rod, the region of reduced radius being remote from a second end of the rod to which a component of an actuator assembly for moving the rod is connectable.

20 Claims, 5 Drawing Sheets

TURBOCHARGER

TECHNICAL FIELD

The present invention relates to a variable geometry turbine. The variable geometry turbine may, for example, form a part of a turbocharger.

BACKGROUND

Turbochargers are well known devices for supplying air to an intake of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to an engine intake manifold. The turbocharger shaft is conventionally supported by journal and thrust bearings, including appropriate lubricating systems, located within a central bearing housing connected between the turbine and compressor wheel housings.

In known turbochargers, the turbine stage comprises a turbine chamber within which the turbine wheel is mounted; an annular inlet passageway defined between facing radial walls arranged around the turbine chamber; an inlet volute arranged around the inlet passageway; and an outlet passageway extending from the turbine chamber. The passageways and chambers communicate such that pressurised exhaust gas admitted to the inlet chamber flows through the inlet passageway to the outlet passageway via the turbine and rotates the turbine wheel. It is also known to improve turbine performance by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suit varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway. Turbochargers provided with a variable geometry turbine are referred to as variable geometry turbochargers.

In one known type of variable geometry turbine, an axially moveable wall member, generally referred to as a "nozzle ring", defines one wall of the inlet passageway. The position of the nozzle ring relative to a facing wall of the inlet passageway is adjustable to control the axial width of the inlet passageway. Thus, for example, as gas flow through the turbine decreases, the inlet passageway width may be decreased to maintain gas velocity and optimise turbine output.

The nozzle ring may be provided with vanes which extend into the inlet and through slots provided in a "shroud" defining the facing wall of the inlet passageway to accommodate movement of the nozzle ring. Alternatively vanes may extend from the fixed facing wall and through slots provided in the nozzle ring.

Typically the nozzle ring may comprise a radially extending wall (defining one wall of the inlet passageway) and radially inner and outer axially extending walls or flanges which extend into an annular cavity behind the radial face of the nozzle ring. The cavity is formed in a part of the turbocharger housing (usually either the turbine housing or the turbocharger bearing housing) and accommodates axial movement of the nozzle ring. The flanges may be sealed with respect to the cavity walls to reduce or prevent leakage flow around the back of the nozzle ring. In one common arrangement the nozzle ring is supported on, or is supported by, rods (sometimes referred to as "pushrods", "push-rods" or "push rods") extending parallel to the axis of rotation of the turbine wheel. The nozzle ring is moved by an actuator assembly which axially displaces the rods.

An example of such a known actuator assembly is disclosed in U.S. Pat. No. 5,868,552. A yoke is pivotally supported within the bearing housing and defines two arms, each of which extends into engagement with an end of a respective nozzle ring support rod.

The yoke is mounted on a shaft journaled in the bearing housing and supporting a crank external to the bearing housing which may be connected to an actuator in any appropriate manner. Each arm of the yoke engages an end of a respective support rod via a block which is pivotally mounted to the end of the yoke on a pin and which is received in a slot defined by the rod which restrains the block from movement along the axis of the rod but allows movement perpendicular to the axis of the rod. An actuator is controlled to pivot the yoke about its support shaft via the yoke crank which in turn causes ends of the yoke arms to describe an arc of a circle. Engagement of the yoke arms with the nozzle ring support rods moves the rods back and forth along their axis. Off axis movement of the yoke arms is accommodated by the sliding motion of the blocks within the slots defined by support rods.

The actuator which moves the yoke can take a variety of forms, including pneumatic, hydraulic and electric forms, and can be linked to the yoke in a variety of ways. The actuator will generally adjust the position of the nozzle ring under the control of an engine control unit (ECU) in order to modify the airflow through the turbine to meet performance requirements.

In use, a torque may be imparted onto the nozzle ring due to gas flow in the turbine. This is particularly the case if the nozzle ring is provided with a plurality of vanes arranged, in use, to deflect gas flowing through the inlet passageway of the turbine towards the direction of rotation of the turbine wheel. A torque on the nozzle ring is also applied to the rods which support the nozzle ring. Torque acting on the rods may push a side of the rods against one or more guides which guide movement of the rods (for example, a bush or bushing or the like). On an opposite side of the rod, where no torque is applied, oil may leak along the rod. Due to the high temperature of the turbocharger environment, the oil may coke. The coke may build up, and over a period of time may inhibit or prevent movement of the rod along the guide.

The dimensions of a nozzle ring may depend on, for example, the type of variable geometry turbocharger, or on the properties of the variable geometry turbocharger. For instance, for aerodynamic reasons, it may be desirable to reduce the radial extent of the nozzle ring (i.e. the extent to which the nozzle ring extends in the radial direction, or in other words the distance between the inner radius and outer radius of the nozzle ring). Even though it may be desirable to provide a nozzle ring with a reduced radial extent, it may at the same time be desirable not to have to re-design or manufacture other related parts in a different way in order to take into account the change in dimensions of the nozzle ring. For example, if the radial extent of the nozzle ring is reduced, commonly used rods may no longer fit into a cavity formed by the nozzle ring and into which the rods extend in order to fix the rods to the nozzle ring. It therefore becomes necessary to re-design and manufacture a new rod which can fit into the cavity provided in the nozzle ring. A typical example of such a re-designed rod would be a rod which is smaller, such that the diameter of the rod is reduced along the entire length of the rod. However, the mechanical properties of such a rod may not be adequate for use in supporting the nozzle ring. For instance, the rod may not be sufficiently stiff or robust enough to withstand the forces and temperatures that, in use, the rod would be subjected to in the turbocharger environment.

SUMMARY

It is an object of the present invention to provide a variable geometry turbine which obviates or mitigates one or more of the problems associated with existing variable geometry turbines, whether identified herein or elsewhere.

According to an embodiment of the present invention, there is provided a variable geometry turbine comprising: a turbine wheel mounted on a turbine shaft within a housing assembly for rotation about a turbine axis, the housing assembly defining a gas flow inlet passage upstream of the turbine wheel; an annular wall member defining a wall of the inlet passage and which is displaceable in a direction substantially parallel to the turbine axis to control gas flow through the inlet passage; at least one moveable rod operably connected via a first end of the rod to the annular wall member, the rod being moveable to control displacement of the annular wall member, the rod extending in a direction substantially parallel to the turbine axis; wherein the rod is provided with a region of reduced radius which extends only partly around the rod, the region of reduced radius being remote from a second end of the rod to which a component of an actuator assembly for moving the rod is connectable.

By providing the rod with a region of reduced radius which extends only partly around the rod (i.e. at least a part of the region having a radius which is the same as that of the remaining part of the rod), various problems associated with existing variable geometry turbines may be obviated or mitigated. For instance, the region of reduced radius provides a greater clearance between the rod and, in one example, a guide configured to guide movement of the rod. The reduced radius region may also facilitate the removal of coke formed on the rod by, for example, facilitating the scraping of the coke against the guide. Another advantage in providing a region of reduced radius is that only that region is provided with a reduced radius. This means that the remaining part of the rod maintains the, for example, improved mechanical properties associated with the rod of a larger diameter. If the region of reduced radius extends to an end of the rod, that end may be attached to an annular wall member (e.g. a nozzle ring). This may be particularly relevant if the annular wall member has a radial extent which is reduced in comparison with, for example, another ring to which push rods of a certain radius are usually attached. The usual (or nominal) radius of the rod can be retained along a portion of the length of the rod (thereby maintaining the structural integrity associated with that radius), while a region of a reduced radius allows the rod to be attached to the annular wall member that has a reduced radial extent.

The region of reduced radius may be adjacent to or form part of the first end of the rod, and may be proximal to the annular wall member.

The turbine may comprises a guide (e.g. a bush or bushing) configured to guide movement of the rod, and/or to support the rod.

The region of reduced radius may be arranged to ensure that, in use, and when the rod is moved along the guide, the region of reduced radius provides a clearance between the rod and the guide.

The rod may be provided with an edge, the edge being formed at a point on the rod where the region of reduced radius is adjacent to a region of nominal radius of the rod. The region of reduced radius may be arranged to ensure that, in use, and when the rod is moved along the guide, the edge passes along the guide.

The guide may define an aperture through which the rod is moveable.

In use, a first side of the rod may be pushed into the guide, and the region of reduced radius may be formed on a second, substantially opposite side of the rod to the first side of the rod.

The annular wall member may be provided with a plurality of vanes arranged, in use, to deflect gas flowing through the inlet passageway towards the direction of rotation of the turbine wheel. Such deflection may impart a torque on the nozzle ring, pushing the rod into the guide.

The first end of the rod may comprise the region of reduced radius, and wherein the reduced radius region may have a radius that is sufficiently small to fit into a cavity provided in the annular wall member, whereas a region of the rod not having the reduced radius region has a radius that is too large to fit into the cavity provided in the annular wall member.

The first end of the rod may comprise the region of reduced radius, and wherein the reduced radius region may have a radius that is sufficiently small to fit into an area extending between inner and outer radii of the annular wall member, whereas a region of the rod not having the reduced radius region has a radius that is too large to fit into the area extending between the inner and outer radii of the annular wall member.

The region of reduced radius may form a surface which is substantially flatter than a surface of a part of the rod not having the region of reduced radius. The rod is oriented such that the substantially flatter surface faces in an inwardly or outwardly radial direction with respect to the turbine axis.

The region of reduced radius may have a radius which is 10% to 60% less than a nominal radius of the rod.

A plurality of rods may be provided, a plurality of those rods having one or more of the features described above in relation to the first aspect of the present invention.

The turbine may form part of a turbocharger.

Other advantageous and preferred features of the invention will be apparent from the following description.

BRIEF DESCRIPTION OF THE FIGURES

Specific embodiments of the present invention will now be described, by way of example only, with reference to the accompanying Figures, in which.

DETAILED DESCRIPTION

Figure 1:
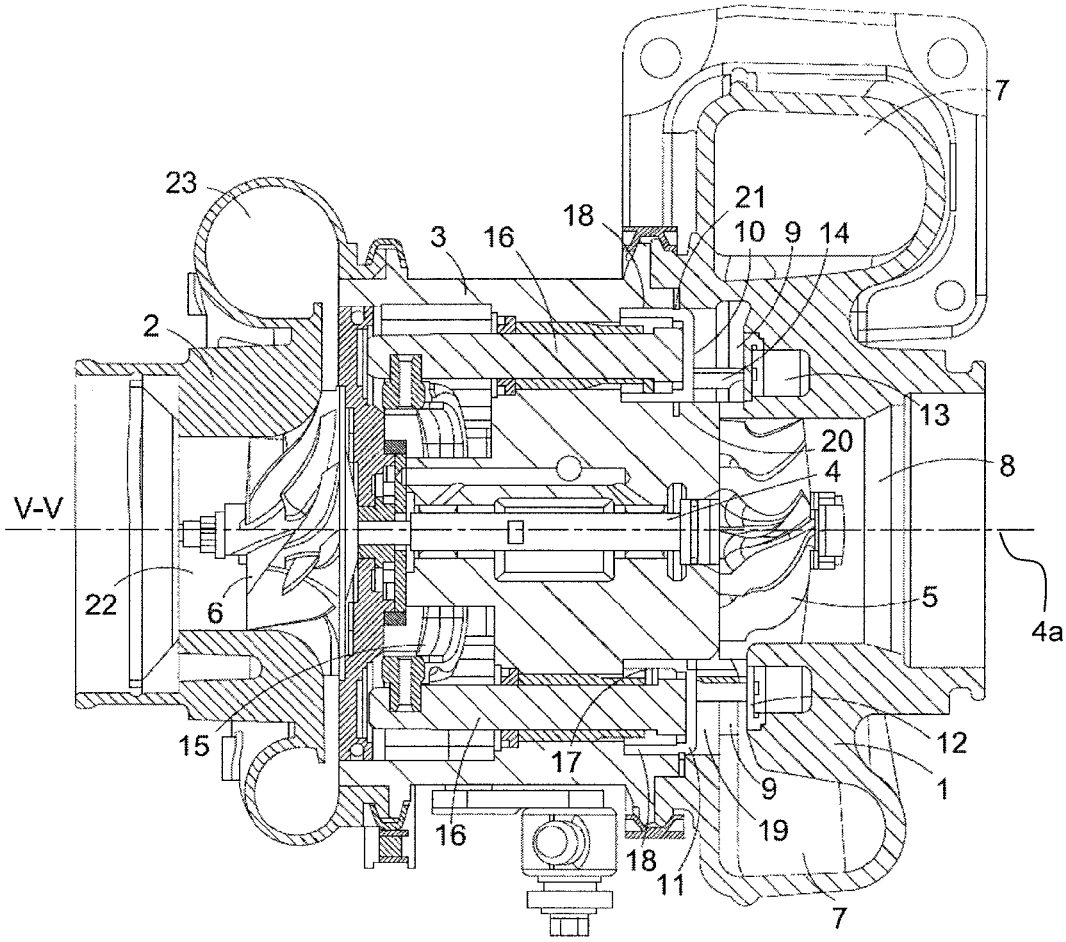
FIG. 1 schematically depicts an axial cross-section through a known variable geometry turbocharger.

FIG. 1 illustrates a known variable geometry turbocharger comprising a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing 3.

The turbine housing 1 defines an inlet volute 7 to which gas from an internal combustion engine (not shown) is delivered. The exhaust gas flows from the inlet chamber 7 to an axial outlet passageway 8 via an annular inlet passageway 9 and turbine wheel 5. The inlet passageway 9 is defined on one side by the face 10 of a radial wall of a movable annular wall member 11, commonly referred to as a "nozzle ring", and on the opposite side by an annular shroud 12 which forms the wall of the inlet passageway 9 facing the nozzle ring 11. The shroud 12 covers the opening of an annular recess 13 in the turbine housing 1.

The nozzle ring 11 supports an array of circumferentially and equally spaced inlet vanes 14 each of which extends across the inlet passageway 9. The vanes 14 are orientated to deflect gas flowing through the inlet passageway 9 towards the direction of rotation of the turbine wheel 5. When the nozzle ring 11 is proximate to the annular shroud 12, the vanes 14 project through suitably configured slots in the shroud 12, into the recess 13. In another embodiment (not shown), the wall of the inlet passageway may be provided with the vanes, and the nozzle ring provided with the recess and shroud.

The position of the nozzle ring 11 is controlled by an actuator assembly of the type disclosed in U.S. Pat. No. 5,868,552 referred to above. An actuator (not shown) is operable to adjust the position of the nozzle ring 11 via an actuator output shaft (not shown), which is linked to a yoke 15. The yoke 15 in turn engages axially extending moveable rods 16 that support the nozzle ring 11. Accordingly, by appropriate control of the actuator (which may for instance be pneumatic or electric), the axial position of the rods 16 and thus of the nozzle ring 11 can be controlled.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 21 is supported within an annular groove formed in the radially outer annular surface of the cavity 19 and bears against the outer annular flange 18 of the nozzle ring 11.

Gas flowing from the inlet chamber 7 to the outlet passageway 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown). The speed of the turbine wheel 5 is dependent upon the velocity of the gas passing through the annular inlet passageway 9. For a fixed rate of mass of gas flowing into the inlet passageway, the gas velocity is a function of the width of the inlet passageway 9, the width being adjustable by controlling the axial position of the nozzle ring 11. FIG. 1 shows the annular inlet passageway 9 fully open. The inlet passageway 9 may be closed to a minimum by moving the face 10 of the nozzle ring 11 towards the shroud 12.

Figure 2:
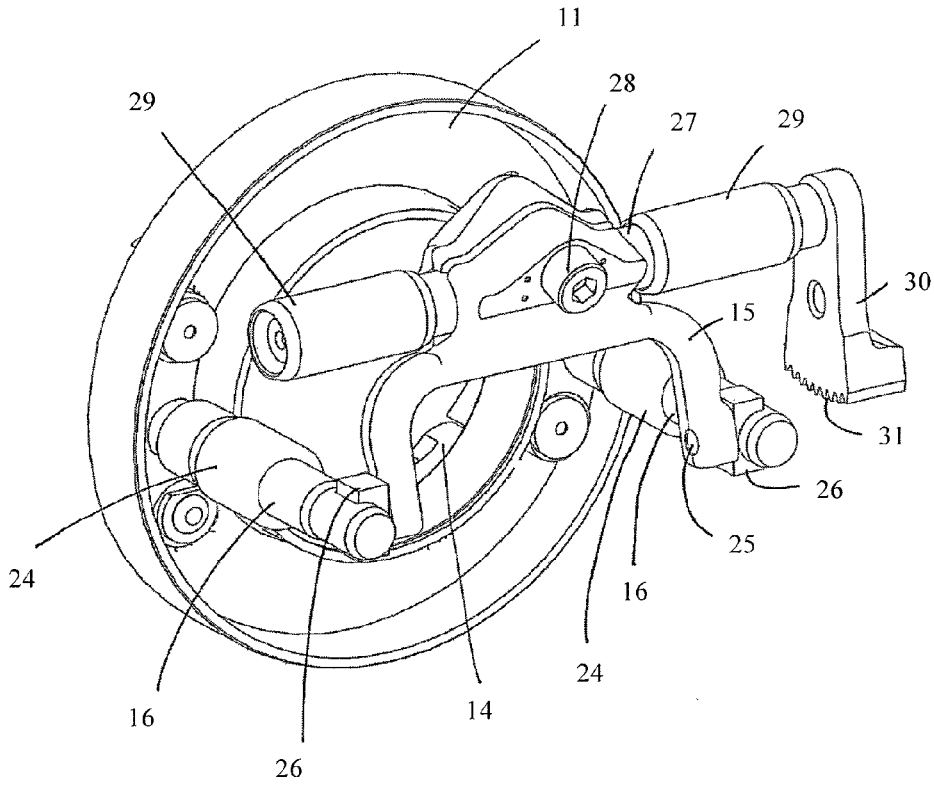
FIG. 2 schematically depicts an enlarged perspective view of components of the nozzle ring actuator assembly of the turbocharger of FIG. 1.

FIG. 2 illustrates components of a nozzle ring and nozzle ring actuator assembly of the general type shown in FIG. 1. These components are shown removed from the turbocharger for clarity. Specifically, FIG. 2 shows the backside of the nozzle ring 11 (facing away from the turbine inlet) supported on rods 16 mounted within bushes 24 for movement parallel to the axis of the turbocharger. Each arm of yoke 15 is connected to a respective rod 16 via a pivot pin 25 (only one of which is visible in FIG. 2) and sliding block 26. Each pivot pin 25 pivotally connects an end of an arm of the yoke 15 to a respective sliding block 26 which is received within a slot defined in the respective support rod 16. The yoke 15 is clamped to a yoke shaft 27 by bolt 28. The yoke shaft 27 is rotatably supported within bearings 29 which are mounted in the bearing housing wall (the bearing housing is not shown in FIG. 2). One end of the yoke shaft 27 is formed with a crank 30 appropriate for connection to an actuator. In the example illustrated in FIG. 2 the crank 30 is a sector gear with teeth 31 suitable for connection to a gear wheel assembly driven by a rotary electric actuator (not shown).

In operation, rotary motion of the electric actuator is transferred to the crank 30 which rotates the yoke shaft 27 about its axis within the bushes 29. This in turn rotates the yoke 15 causing the pins 25 to describe an arc of a circle. This causes the blocks 26 to move axially with the rods 16, whilst sliding within the slots to accommodate off axis movement of the pins 25. The nozzle ring 11 is thereby moved along the axis of the turbocharger by rotation of the yoke 15.

Figure 3:
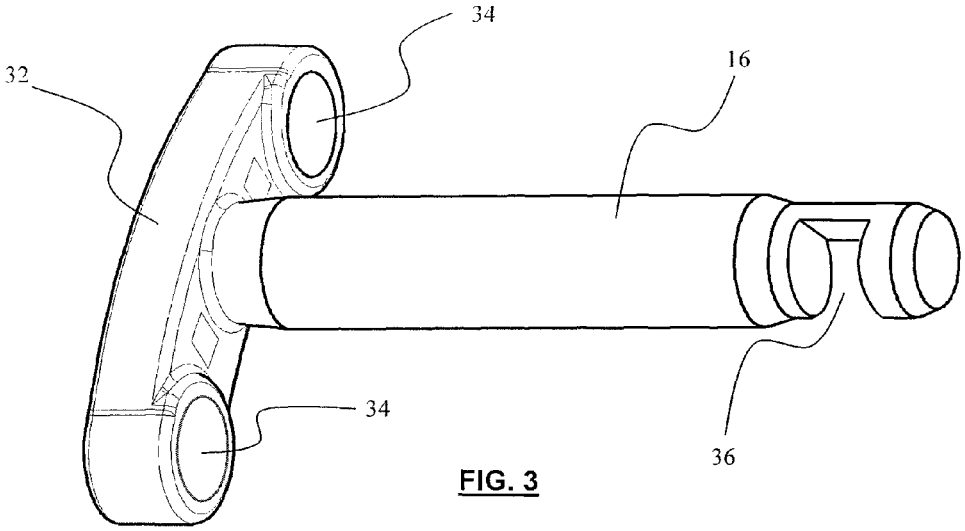
FIG. 3 schematically depicts an enlarged perspective view of a bracket and rod for supporting the nozzle ring of a turbocharger of FIGS. 1 and 2.

FIG. 3 schematically depicts an enlarged perspective view of components of FIGS. 1 and 2. FIG. 3 shows a rod 16. A first end of the rod 16 is attached to a bracket 32. The bracket 32 facilitates the operable connection of the rod 16 to the nozzle ring shown in and described with reference to FIGS. 1 and 2. Referring back to FIG. 3, the bracket is provided with apertures 34 to facilitate this connection. A second end of the rod 16 is provided with a slot 36 (as described above) to which a component of an actuator assembly for moving the rod 16 is connectable (for example, the sliding blocks referred to above in relation to FIG. 2).

Figure 4:
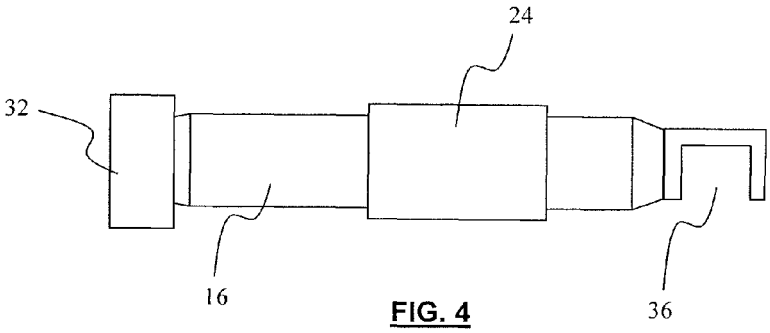
FIG. 4 schematically depicts a side-on view of the bracket and rod shown in FIG. 3 relative to a bush.

FIG. 4 schematically depicts a side-on view of the bracket and rod of FIG. 3 in relation to a bush 24. The rod 16 extends through the bush 24. The bush 24 serves as a guide for guiding movement and/or providing support to the moveable rod 16, and may be generically described as a guide.

Figure 5:
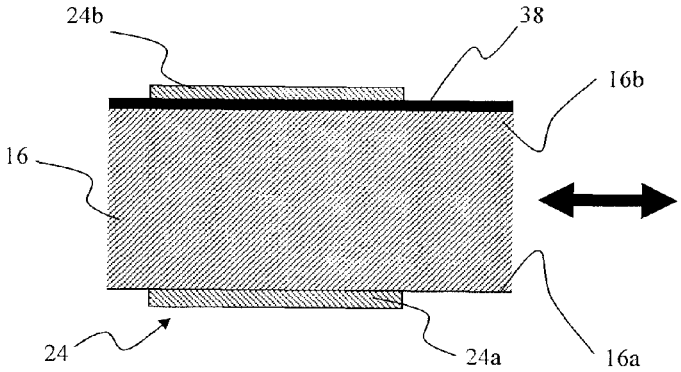
FIG. 5 schematically depicts a cross-section view of the rod and bush of FIG. 4, together with the problem of coking.

As described above, in use a torque may be imparted onto the rod 16 which may push a side of the rod 16 into the bush 24. Oil may leak or flow along an opposite side of the rod 16 which is not being pushed against the bush 24. FIG. 5 schematically depicts this situation.

Referring to FIG. 5, a first side of the rod 16*a* is shown as being pushed against a first side of the bush 24*a*. On a second, opposite side of the rod 16*b* which has not been subjected to a torque, oil has been deposited. Due to the extreme temperatures in the turbocharger, the oil has coked 38. Over time, the coke 38 may inhibit or prevent movement of the rod 16 through the bush 24. Inhibition or prevention may occur, for example, due to the coke 38 becoming wedged between a second side of the rod 16*b* which is not subjected to a torque and a second, opposing side of the bush 24*b*. If the rod 16 is unable to move, or the movement is not as intended, the control of the functionality of the turbine will be adversely affected, since it will not be possible to move the nozzle ring in the intended manner. It is desirable to obviate or mitigate this problem.

According to an embodiment of the present invention, the rod (or one or more rods) which supports the nozzle ring is provided with a region of reduced radius. The region of reduced radius extends only partly around the rod (such that a part of the rod in that region has the same radius as parts of the rod not forming part of the region of reduced radius). The region of reduced radius is remote from an end of the rod to which a component of an actuator assembly for moving the rod 16 is connectable (i.e. the second end of the rod referred to above). As will be discussed in more detail below, the provision of the region of reduced radius is advantageous, since it obviates or mitigates the problem of coking. The region of reduced radius also allows rods having a nominal radius that would otherwise not be connectable to a nozzle ring having a reduced radial extent (due to the radius being too big) to be connectable to that nozzle ring. Specific embodiments of the invention will now be described, by way of example only, with reference to FIGS. 6 to 11.

Figure 6:
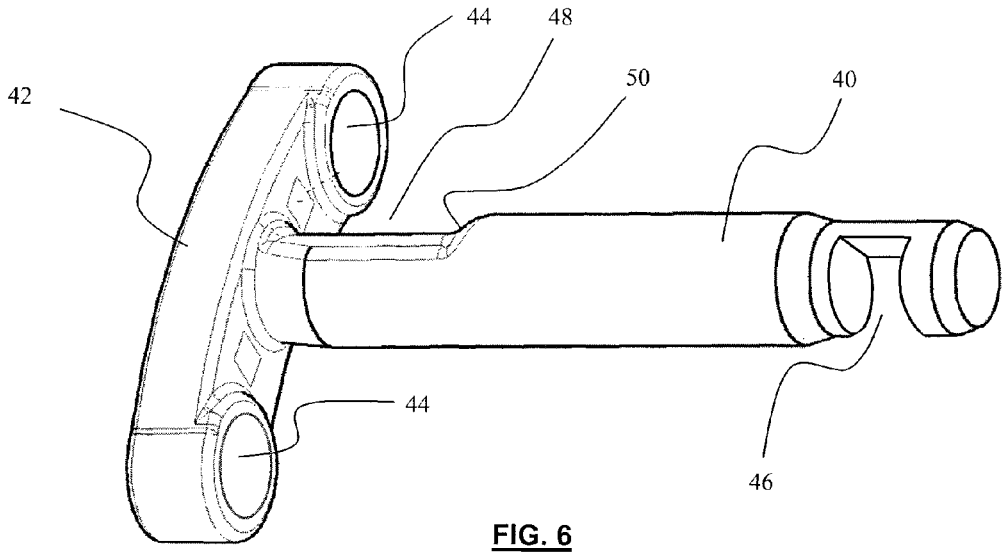
FIG. 6 schematically depicts an enlarged perspective view of a rod in accordance with an embodiment of the present invention, together with a bracket.

FIG. 6 schematically depicts a perspective view of a rod 40 in accordance with an embodiment of the present invention. A first end of the rod 40 is attached to a bracket 42 which facilitates the operable connection of the rod 40 to the nozzle ring described above. The bracket 42 is provided with apertures 44 which facilitate this connection. A second end of the rod 40 is provided with a slot 46 to which a component of an actuator assembly for moving the rod 40 is connectable, for example the sliding block described above.

According to an embodiment of the present invention, the rod 40 is provided with a region of reduced radius 48. The region of reduced radius 48 extends only partly around the rod 40 (i.e. the region of reduced radius does not extend around an entire circumference of the rod 40). The region of reduced radius 48 is remote from the second end of the rod 40 to which a component of an actuator assembly for moving the rod 40 is connectable. In particular, in this embodiment the region of reduced radius 48 is proximal to the bracket 42, and, in use, proximal to the nozzle ring to which the bracket 42 and rod 40 are connected. The region of reduced radius 48 extends along a part of the length of the rod 40. The extent to which the region of reduced radius 48 extends along the rod will be dependent on, for example, the length of the rod 40 and the location of other components used in conjunction with the rod 40, for example one or more bushes (or, in general terms, guides).

The region of reduced radius 48 is formed by providing a generally flattened portion at the second end of the rod 40. The region of reduced radius 48 may be provided by casting the rod 40 with the region of reduced radius 48. In another example, an already cast rod may be undercut or the like to provide the region of reduced radius 48. Casting the rod 40 with the region of reduced radius 48 may be preferable, since less process steps are then required to form the rod 40 with a region of reduced radius 48.

The provision of a reduced radius region also provides the rod with an edge 50. The edge is formed at a point on the rod 40 where the region of reduced radius 48 is adjacent to a region of nominal radius (i.e. at the point at which the radius of the rod changes). The significance of the edge 50 will be described in more detail below.

Figure 7:
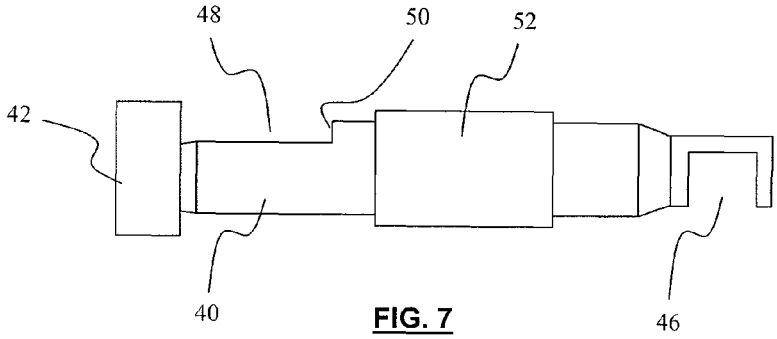
FIG. 7 schematically depicts a side-on view of the rod and bracket of FIG. 6 in relation to a bush.

FIG. 7 schematically depicts a side-on view of the bracket 42 and rod 40 of FIG. 6. FIG. 7 further depicts a bush 52 through which the rod 40 extends and is moveable. The region of reduced radius 48 is located on the rod 40, or extends sufficiently along the rod 40, to ensure that the edge 50 of the rod 40 passes along the bush 52 (for example, such that the edge 50 passes along a part or all of an internal surface of the bush 52). By ensuring that the region of reduced radius 48 is located on the rod, or extends along the rod, in this manner relative to the bush (or, more generally speaking, a guide of the rod) the edge 50 of the rod 40 may be used to obviate or mitigate the problem of coking described above. Furthermore, by ensuring that, in use, the region of reduced radius 48 passes at least partially through the bush 52, additional clearance is provided between the rod 40 and the bush 52 which may also obviate or mitigate the problem of coking as described above.

Figure 8:
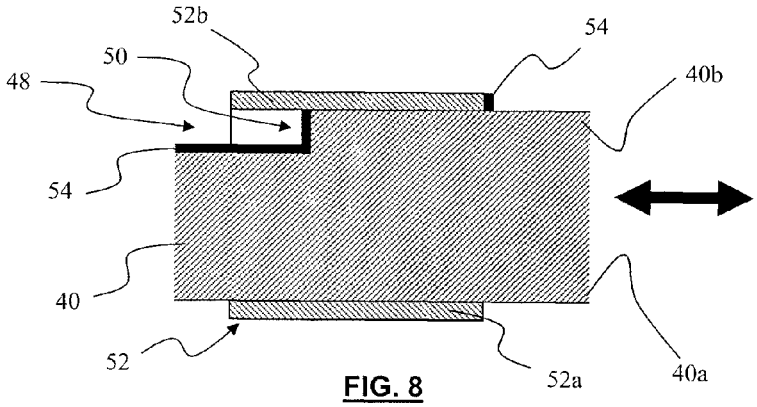
FIG. 8 schematically depicts a cross-section view of the rod and bush of FIG. 7, illustrating the obviation or mitigation of the problem of coking.

FIG. 8 shows a section-view of part of the rod 40 as it is moved through the bush 52. As discussed above, in use, a torque will be applied to the rod 40, pushing a first side of the rod 40*a* against a first side of the bush 52*a*. At the same time, oil leaks along a second, opposite, side of the rod 40*b* adjacent to a second, opposite, side of the bush 52*b*. Due to the high temperature environment of a turbocharger, the oil thickens and forms coke 54 on and around the second side of the rod 40*b*.

The rod 40 is moveable within the bush 52. The region of reduced radius 48 is located on the rod 40, or extends along the rod 40 by a sufficient amount to ensure that, in use, the edge 50 passes at least partially along and within the bush 52. The region of reduced radius 48, and therefore edge 50, are located on a side of the rod 40 which, in use, becomes coked (in this example, the second side 40*b* of the rod). This side of the rod 40*b* is the side on which no torque is applied.

In use, movement of the rod 40 within the bush 52 causes the edge 50 to pass into and/or within and along the bush 52. In doing so, the edge 50 facilitates scraping of the coke 54 off the rod 40. Furthermore, the region of reduced radius provides additional clearance between the bush 52 and the rod 40. The scraping of coke 54 from the rod 40, together with the additional clearance provided by the region of reduced radius 48 obviates or mitigates the problem of coking. Since the problem of coking is obviated or mitigated, movement of the rod 40 within the bush 52 is less likely to be inhibited or prevented by such coking. A further advantage associated with the location of the region of reduced radius on the side of the rod that is not subjected to a torque is that the opposite side of the rod which is subjected to a torque continues to provide a continuous, load-bearing surface for withstanding the torque as the rod is pushed against the bush.

Figure 9:
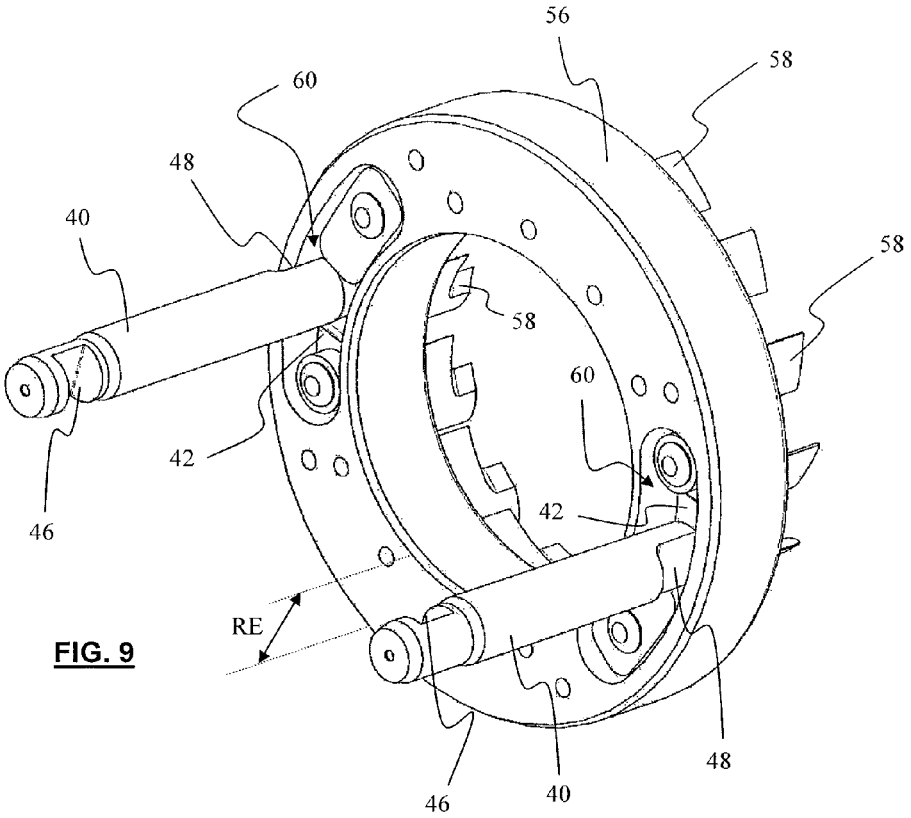
FIG. 9 schematically depicts a perspective view of a nozzle ring, together with rods in accordance with an embodiment of the present invention.

FIG. 9 schematically depicts a perspective view of a nozzle ring 56, together with rods 40 for supporting that nozzle ring in accordance with an embodiment of the present invention. The nozzle ring 56 is provided with a plurality of nozzle ring vanes 58 which extend from a face of the nozzle ring and in an axial direction. An opposite face of the nozzle ring 56 is provided with two cavities 60. The cavities are provided for the connection of the nozzle ring 56 to support rods 40 via brackets 42. The rods 40 and brackets 42 have the same features as shown in and described with reference to 56 and so the description of features shown in FIG. 6 apply equally to the description of the same features shown in FIG. 9.

The nozzle ring 56 has a radial extent RE, which is the thickness of the nozzle ring 56 in the radial direction (or in other words the distance between the inner and outer radii of the nozzle ring 56). The radial extent RE of the nozzle ring 56 is substantially the same as or less than the nominal diameter of the rods 40 (i.e. the region of the rods 40 which do not form part of the region of reduced radius 48). Because the radial extent RE of the nozzle ring 56 is substantially the same as or smaller than the nominal diameter of the rods 40, rods having this nominal diameter along their entire length could not be connected to the nozzle ring 56, or it would at least be difficult to make such a connection. When faced with this problem, one approach would be to reduce the nominal diameter of the rods along their entire length (i.e. provide a smaller-diameter rod) and then attach them to the nozzle ring. However, this approach is disadvantageous, since a rod with a reduced diameter along its entire length may not have the required mechanical stability associated with rods of a larger diameter.

In accordance with an embodiment of the present invention, rods 40 with a nominal diameter are provided with a region of reduced radius 48 via which connection to the nozzle ring 56 may be made. The region of reduced radius is sufficiently small to fit into the cavity 60 provided in the nozzle ring. Conversely, the diameter of regions of the rod 40 not forming the reduced radius region 48 may exceed the dimensions of the cavity, for example the radial extent RE of the nozzle ring 56. One or more cavities 60 may not be provided in the nozzle ring. Instead, a continuous face may be provided, and to which the rods 40 are to be attached. In this case, the region of reduced radius is sufficiently small to fit into an area extending between an inner and outer radius of the nozzle ring 56 (i.e. within the radial extent). Conversely, the remaining part of the rod may have a diameter which is not sufficiently small to fit into the area extending between an inner and outer radius of the nozzle ring 56.

By using the reduced radius of the rods 40 to attach the rods of a larger nominal diameter to a nozzle ring the problems with the approach discussed above are obviated or mitigated. For example, a rod with a region of reduced radius allows a rod with a larger nominal diameter to be attached to a nozzle ring with, for example, a reduced radial extent RE. The reduced radial extent may result, for example, from a redesign of the nozzle ring to improve functional or structural properties of the nozzle ring, for example the aerodynamic performance of the nozzle ring. The region of reduced radius may provide clearance for thermal expansion or contract of the rod or the nozzle ring.

Figure 10:
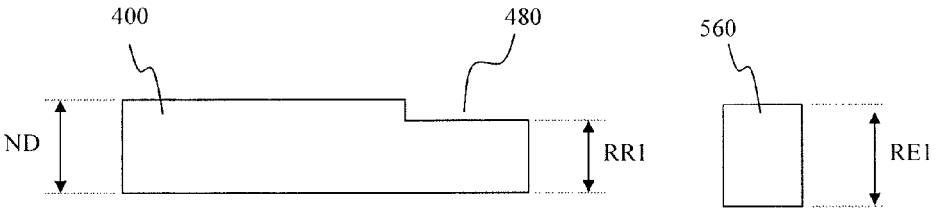
FIGS. 10 and 11 schematically depict inventive principles associated with a region of reduced radius of a rod in accordance with an embodiment of the present invention.

FIG. 10 schematically depicts a side-view of a rod 400 in accordance with an embodiment of the present invention. The rod 400 has a nominal diameter ND, and a region of reduced radius 480 at an end of the rod 400 to which connection to a nozzle ring 560 is to be made. The nozzle ring 560 has a radial extent RE1. It can be seen that the region of reduced radius 480 has is shaped RR1 so that it can fit into or onto the radial extent RE1 of the nozzle ring 560.

Figure 11:
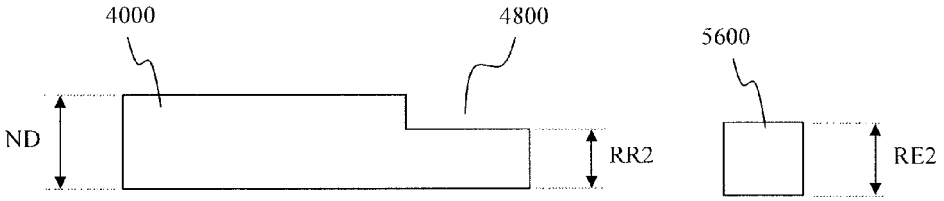

FIG. 11 schematically depicts a side-view of a rod 4000 in accordance with an embodiment of the present invention. The rod 4000 has a nominal diameter ND which is the same as the nominal diameter of the rod of FIG. 10. The rod 4000 has a region of reduced radius 4800 at an end of the rod 4000 to which connection to a nozzle ring 5600 is to be made. The nozzle ring 5600 has a radial extent RE2, which is reduced in comparison with the radial extent of the rod of FIG. 10. Although the nominal diameter of the rod 4000 is the same as the rod of FIG. 10, and the radial extent RE2 of the nozzle ring is reduced in comparison with the radial extent of the rod of FIG. 10, the rod 4000 of FIG. 11 can still be accommodated by the nozzle ring 5600. This is because the region of reduced radius 4800 of the rod 4000 is shaped RR2 so that it can fit into or onto the radial extent RE2 of the nozzle ring 5600.

Referring back to FIG. 9, the region of reduced radius 48 of the rod 40 extends only partly around the rod 40. Because the region of reduced radius extends only partly around the rod 40, this may have an influence on the orientation of the rods 40 in their attachment to the nozzle ring 56. For instance, it can be seen in FIG. 9 that the rods 40 are oriented such that flattened regions of the rod 40 forming the regions of reduced radius 48 are oriented in such a way that they face in a radial direction with respect to turbine axis.

In one example, the region of reduced radius may form a surface which is substantially flatter than a surface of a part of the rod not having the region of reduced radius. The rod may be oriented such that the substantially flatter surface faces in an inwardly or outwardly radial direction with respect to the turbine axis.

The regions of reduced radius as discussed above preferably have a reduced radius which does not, to a great extent, affect the mechanical properties of that part of the rod. For instance, the radius of the rod in the region of reduced radius may be 10% to 60% less than the nominal radius of the rod (i.e. the diameter may be 5% to 30% of the nominal diameter). The reduced radius region may, as discussed above, extend from an end of the rod, and along the rod. The length to which the region of reduced radius extends may be, for example, comparable with, or less than the depth (i.e. thickness) of the nozzle ring in the axial direction.

The region of reduced radius may be shaped so that the reduction and mechanical strength of that region as a result of reduction of radius is compensated for by that shape. For example, the region of reduced radius may additionally be widened, for example, to form a spade-like shape, to partially compensate for the decreased mechanical strength.

Whilst the invention has been illustrated in its application to the turbine of a turbocharger, it will be appreciated that the invention can be applied to variable geometry turbines in other applications.

Other possible modifications to the detailed structure of the illustrated embodiment of the invention will be readily apparent to the appropriately skilled person. Various modifications may be made to the embodiments of the invention described above, without departing from the present invention as defined by the claims that follow.

The invention claimed is:

1. A variable geometry turbine comprising:

a turbine wheel mounted on a turbine shaft within a housing assembly for rotation about a turbine axis, the housing assembly defining a gas flow inlet passage upstream of the turbine wheel;

an annular wall member defining a wall of the inlet passage and which is displaceable in a direction substantially parallel to the turbine axis to control gas flow through the inlet passage;

at least one moveable rod operably connected via a first end of the rod to the annular wall member, the rod being moveable to control displacement of the annular wall member, the rod extending in a direction substantially parallel to the turbine axis;

wherein the rod is provided with a region of reduced radius which extends only partly around the rod, the region of reduced radius being remote from a second end of the rod to which a component of an actuator assembly for moving the rod is connectable.

2. The turbine as claimed in claim 1, wherein the region of reduced radius is adjacent to or forms part of the first end of the rod, and is proximal to the annular wall member.

3. The turbine as claimed in claim 2, wherein the turbine comprises a guide configured to guide movement of the rod, and/or to support the rod.

4. The turbine as claimed in claim 2, wherein the annular wall member is provided with a plurality of vanes arranged, in use, to deflect gas flowing through the inlet passageway towards the direction of rotation of the turbine wheel.

5. The turbine as claimed in claim 2, wherein the first end of the rod comprises the reduced radius region, and wherein the reduced radius region has a radius that is sufficiently small to fit into a cavity provided in the annular wall member, whereas a region of the rod not having the reduced radius region has a radius that is too large to fit into the cavity provided in the annular wall member.

6. The turbine as claimed in claim 1, wherein the turbine comprises a guide configured to guide movement of the rod, and/or to support the rod.

7. The turbine as claimed in claim 6, wherein the region of reduced radius is arranged to ensure that, in use, and when the rod is moved along the guide, the region of reduced radius provides a clearance between the rod and the guide.

8. The turbine as claimed in claim 7, wherein the rod is provided with an edge, the edge being formed at a point on the rod where the region of reduced radius is adjacent to a region of nominal radius of the rod.

9. The turbine as claimed in claim 7, wherein the guide defines an aperture through which the rod is moveable.

10. The turbine as claimed in claim 6, wherein the rod is provided with an edge, the edge being formed at a point on the rod where the region of reduced radius is adjacent to a region of nominal radius of the rod.

11. The turbine as claimed in claim 10, wherein the region of reduced radius is arranged to ensure that, in use, and when the rod is moved along the guide, the edge passes along the guide.

12. The turbine as claimed in claim 6, wherein the guide defines an aperture through which the rod is moveable.

13. The turbine as claimed in claim 6, wherein, in use, a first side of the rod is pushed into the guide, and wherein the region of reduced radius is formed on a second, substantially opposite side of the rod to the first side of the rod.

14. The turbine as claimed in claim 1, wherein the annular wall member is provided with a plurality of vanes arranged, in use, to deflect gas flowing through the inlet passageway towards the direction of rotation of the turbine wheel.

15. The turbine as claimed in claim 1, wherein the first end of the rod comprises the reduced radius region, and wherein the reduced radius region has a radius that is sufficiently small to fit into a cavity provided in the annular wall member, whereas a region of the rod not having the reduced radius region has a radius that is too large to fit into the cavity provided in the annular wall member.

16. The turbine as claimed in claim 1, wherein the first end of the rod comprises the reduced radius region, and wherein the reduced radius region has a radius that is sufficiently small to fit into an area extending between inner and outer radii of the annular wall member, whereas a region of the rod not having the reduced radius region has a radius that is too large to fit into the area extending between the inner and outer radii of the annular wall member.

17. The turbine as claimed in claim 1, wherein the region of reduced radius forms a surface which is substantially flatter than a surface of a part of the rod not having the region of reduced radius.

18. The turbine as claimed in claim 17, wherein the rod is oriented such that the substantially flatter surface faces in an inwardly or outwardly radial direction with respect to the turbine axis.

19. The turbine as claimed in claim 1, wherein the region of reduced radius has a radius which is 10% to 60% less than a nominal radius of the rod.

20. The turbine as claimed in claim 1, wherein the turbine forms part of a turbocharger.

* * * * *